United States Patent [19]

Colamussi

[11] Patent Number: 4,901,502

[45] Date of Patent: Feb. 20, 1990

[54] APPARATUS FOR FEEDING GROUPS OF CONES AND/OR CONOIDS IN AN ORDERED AND ORIENTATED ARRANGEMENT TO BOXES IN A BOXING PLANT

[75] Inventor: Arturo Colamussi, Ferrara, Italy

[73] Assignee: Vortex Systems S.r.l., Fossalta Di Copparo, Italy

[21] Appl. No.: 214,441

[22] Filed: Jul. 1, 1988

[30] Foreign Application Priority Data

Jul. 23, 1987 [IT] Italy ..... 21406 A/87

[51] Int. Cl.[4] ..... B65B 5/06; B65B 35/40; B65B 35/44

[52] U.S. Cl. ..... 53/143; 53/537; 53/544; 53/247; 53/249; 53/252

[58] Field of Search ..... 53/143, 150, 537, 531, 53/148, 247, 249, 252, 544

[56] References Cited

U.S. PATENT DOCUMENTS

| | | | |
|---|---|---|---|
| 3,143,223 | 8/1964 | McIntyre et al. | 53/143 X |
| 3,313,394 | 4/1967 | Mills et al. | 53/143 X |
| 3,802,154 | 4/1974 | Dillon | 53/247 X |
| 3,878,665 | 4/1975 | Couten | 53/143 |
| 4,079,575 | 3/1978 | Focke et al. | 53/148 X |
| 4,192,415 | 3/1980 | Krener et al. | 53/143 X |
| 4,555,892 | 12/1985 | Dijkman | 53/537 X |
| 4,781,011 | 11/1988 | Prakken | 53/247 X |

*Primary Examiner*—Horace M. Culver

*Attorney, Agent, or Firm*—Charles E. Brown; Charles A. Brown

[57] ABSTRACT

In a boxing plant for cones and/or conoids which at its inlet are disposed in groups of a certain number each, an apparatus for feeding groups of cones in an orientated and ordered arrangement to boxes comprises a first section (A) in which groups of cones (11) positioned on a container tray (12) in an essentially horizontal plane are orientated in a predetermined manner on opposite sides so that they all lie with their tails pointing towards the center, and a second section (B) in which they are discharged from the container trays (12) onto racks (15) and the cones (11) on one side are offset relative to the cones on the other side, and then moved while offset onto a central region (16) which can be opened in the manner of a sliding door above boxes (17) and in which the cones (11) disposed side by side in a head-tail arrangement are compacted (18) into matrices (44) having the same dimensions as the boxes and are then allowed to fall into the boxes by opening the sliding door.

16 Claims, 7 Drawing Sheets

APPARATUS FOR FEEDING GROUPS OF CONES AND/OR CONOIDS IN AN ORDERED AND ORIENTATED ARRANGEMENT TO BOXES IN A BOXING PLANT

This invention relates to an apparatus for feeding groups of cones and/or conoids in an ordered and oriented arrangement to boxes in a boxing plant.

In the particular case of ice cream cones, after leaving the production plants and cooling and deep-freezing tunnels, the cones and/or conoids must be boxed, generally in cardboard boxes, in an ordered arrangement for dispatch to wholesalers and retailers. Each box, which can vary in volume according to the number of prepared cones to be stored, houses the cones in an ordered arrangement in the form of an intercalated "head-tail" sequence which allows rational and optimum utilization of the entire box. If this positioning is done for example manually, a considerable time is required with consequent high costs and without the possibility of automating the operations for example downstream of the cooling tunnel.

An object of the present invention is to provide an apparatus for incorporation into a cone boxing plant by which any requirement for manual operation after groups of a predetermined number of cones have been fed in is completely obviated, and the positioning of the cones in the box is optimized so that they assume under high-speed conditions an ordered head-tail arrangement in a essentially horizontal position in a manner which prevents any possible damage.

A further object is to form several layers within one box. Such an apparatus must also be able to operate when the cone dimensions and number of cones forming the feed groups varies. These and further objects are attained by the apparatus of the present invention, which solves all the aforementioned problems and allows optimum automatic operation of the boxing plant.

The apparatus is substantially characterised by comprising:

(a) a first section comprising a pair of parallel conveyors, driven by an intermittently operated geared motor unit, for container trays carrying in cavity seats groups of cones of predetermined number, the container trays are disposed transversely to the movement of the pair of conveyors so as to lay side-by-side during their translational motion, and are rotatable by cam means in an essentially horizontal plane parallel to that in which the groups of cones are disposed;

(b) a second section in which the container trays of one conveyor of the pair are arranged side by side and face respective container trays of the other parallel conveyor of the pair so that the groups of cones of the one are in parallel alignment with and facing groups of cones of the other, and with their tails pointing towards the center of the associated conveyor, there being associated with each side of the second section means movable transversely to the conveyors for transferring the groups of cones from the container trays to a position above centrally positioned container boxes;

(c) first collection means provided the groups of cones transferred from the container trays, the first collection means is essentially of the rack type and positioned to the side of the conveyors towards the center of the second section, and both being provided with actuators which move them horizontally in opposite directions parallel to the movement of the conveyors so as to offset the cones present on the one with respect to the cones present on the other;

(d) second collection means provided by the groups of cones transferred from the first collection means, the second collection means is disposed centrally of the second section and consist of flat blade elements which can be opened out about the container boxes are receiving the cones fed by the transfer means from both sides, and after the cones have been intercalated in a head-tail arrangement and have been divided and compacted into a number of identical matrices of the same dimensions as the underlying boxes of an associated compactor means with blades transverse to the second section, the blades are movable parallel to the movement of the conveyors by at least one actuator.

Preferably, below the blades are the central region of the second section and in a position corresponding therewith. There is longitudinally disposed a box conveyor for feeding open empty boxes in succession and for evacuating them once filled with cones, for example by feeding them to a closing machine.

The apparatus according to the invention as heretofore defined is provided with suitable auxiliary control and synchronised drive means to ensure its correct and automatic operation.

Further characteristics and structural and operational details of the apparatus according to the present invention will be more apparent from the description of one embodiment thereof given hereinafter by way of non-limiting example with reference to the accompanying drawings in which.

Figure 2:
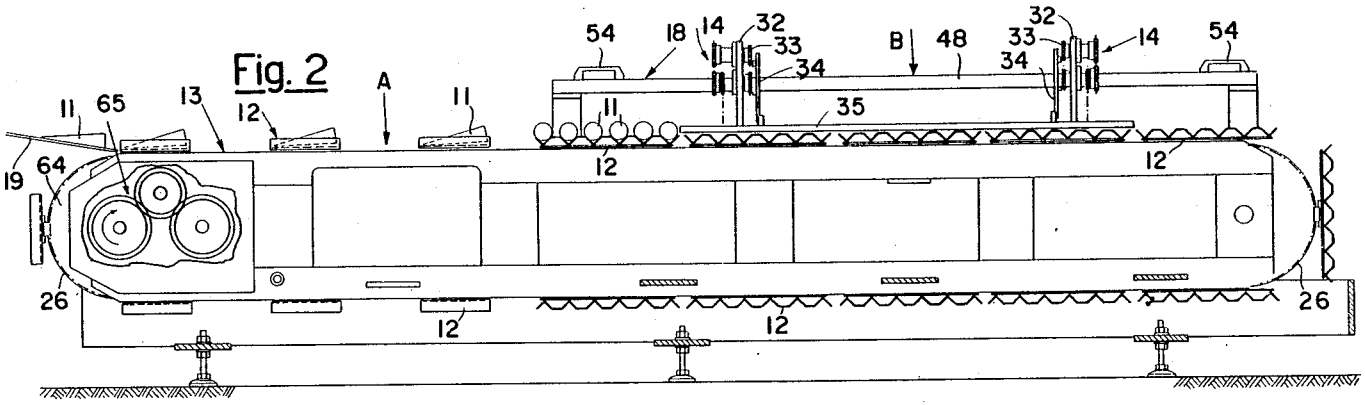
FIG. 2 is a diagrammatic elevation of the apparatus.

The figures illustrate the apparatus according to the invention, in which groups of cones 11, housed on container trays 12, pass from a first section A to a second section B, on which the container trays 12 driven by a pair of conveyors 13 undergo rotation. The groups of cones 11 of the two conveyors 13, which in the second section B face each other with their tails pointing towards the center of the apparatus, are transferred by transfer means 14 from the container trays 12 onto first rack-shaped collection means 15, on which the cones of the one are staggered relative to the cones of the other. Afterwards, the cones are transferred onto second central collection means 16 positioned above open cardboard boxes 17. When the cones intercalated in a head-tail arrangement have been compacted by a compactor means 18 the second collision means 16 are opened in sliding door manner to cause the compacted cones to fall into the underlying boxes.

Figure 1:
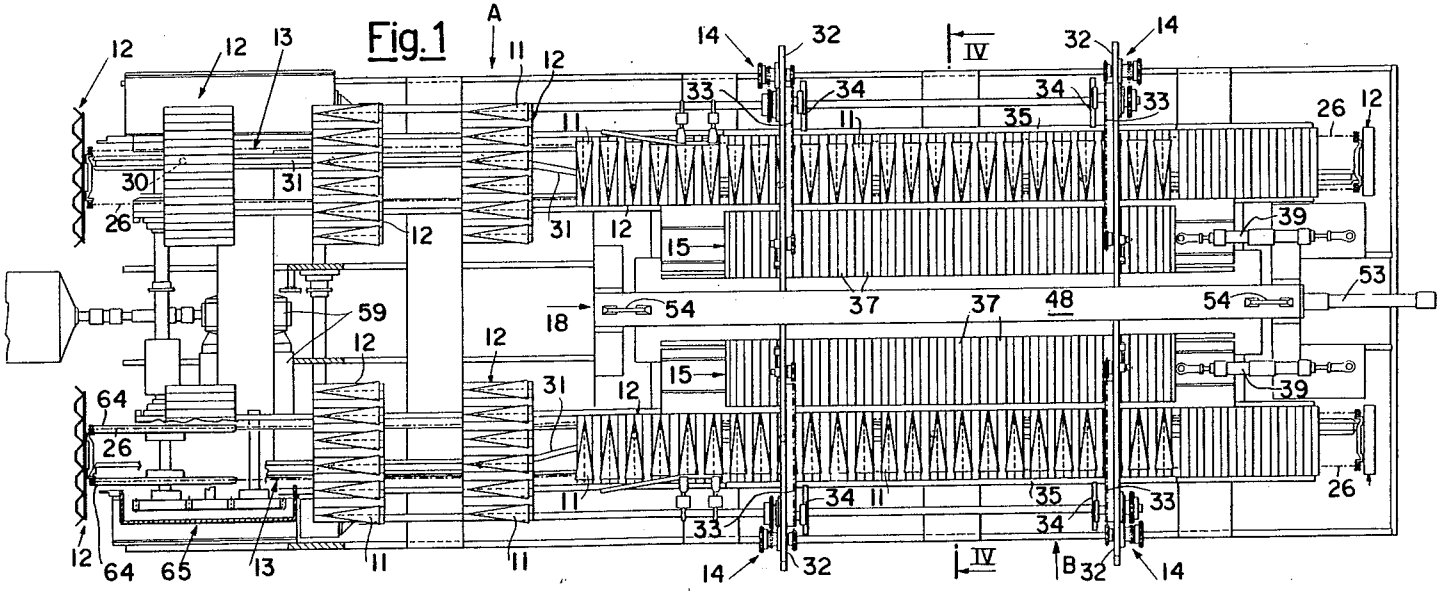
FIG. 1 is a diagrammatic plan view of the apparatus.
Figure 3:
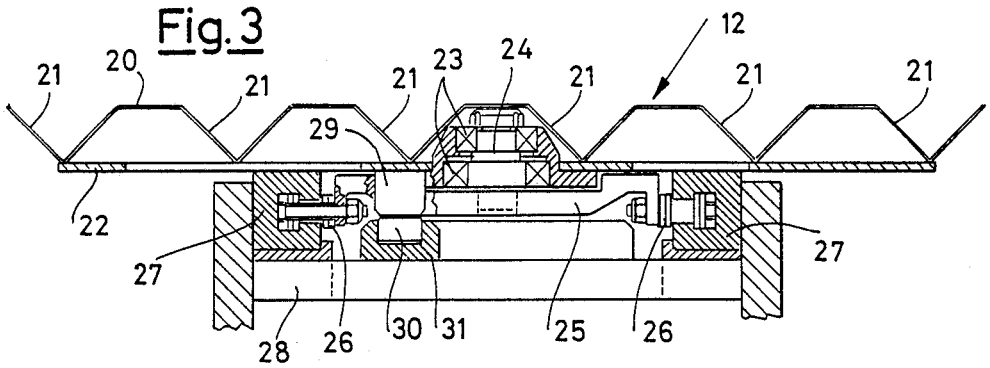
FIG. 3 is a cross-sectional detailed view of a container tray positioned in the first section.
Figure 5:
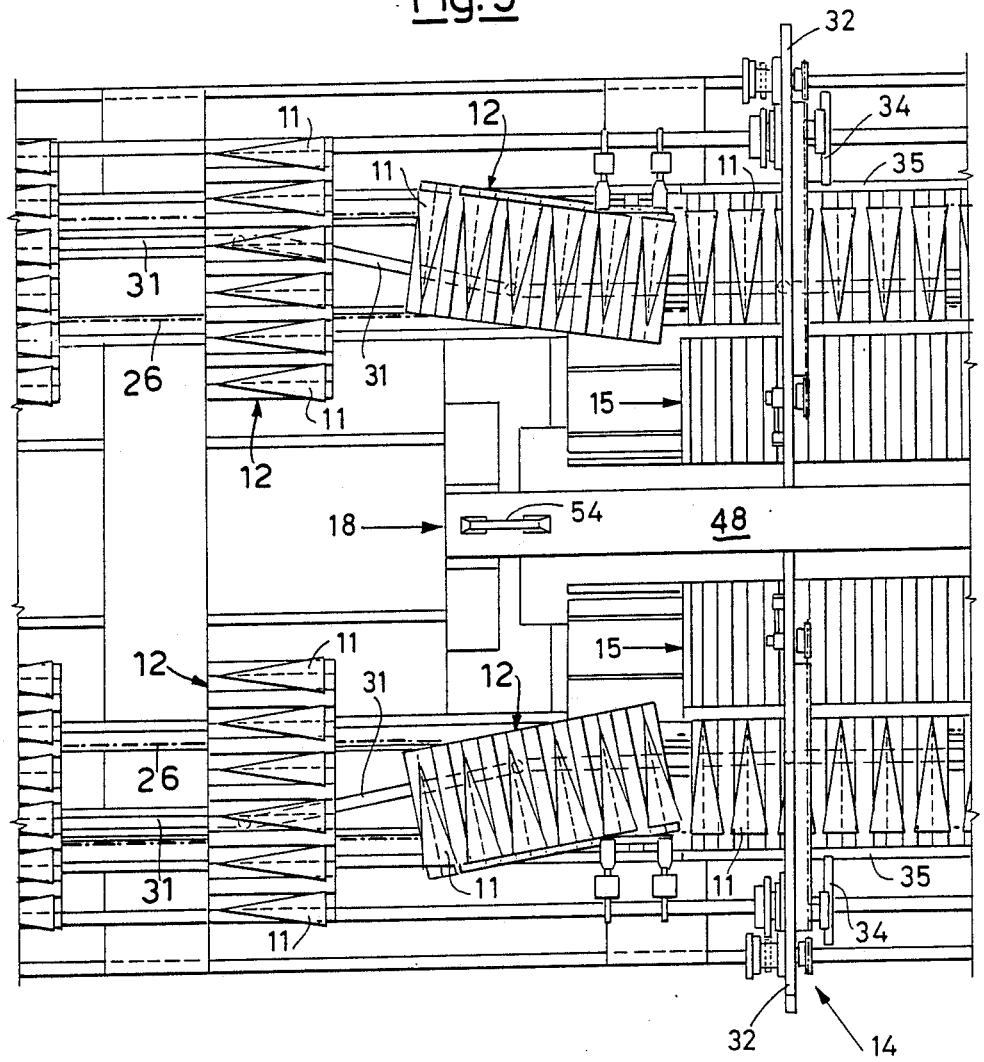
FIG. 5 is an enlarged plan view of a portion of the apparatus in a different operating position from FIG. 1.

Upstream of the first section A of the apparatus there is provided for example a chute indicated schematically by 19 which is provided with pushers (not shown) to feed the container trays 12 containing a predetermined number of cones 11. There are six cones per tray in this particular example. The purpose of the chute 19 is to constantly feed a correct number of cones 11 as the container trays 12 pass in succession. Preferably, the chute 19 has a cross-section similar to that of the container trays 12. The chute 19 as seen from FIG. 3 comprise an upper plate 20 of stainless steel or plastics material shaped to form a set of six equidistant V-shaped seats 21 of such length and width as to be able to receive the largest cones. The shaped plate 20 is rigid with a base plate 22, through the center of which there is mounted on bearings 23 one end of a rotatable shaft 24. The other end of shaft 24 is rigid with a support 25. The support 25 is rigidly mounted transversely on a pair of chains 26 which together with slide guides 27 rigid with the frame 28 form one of the two conveyors 13. The supports 25 must be at least equal in number to the number of container trays 12 and be positioned at regular intervals so as to lie side-by-side on the two conveyors 13. Below the base plate 22 of the container tray 12 there extends an eccentric pin 29 provided with a wheel 30 which is inserted into an endless track 31 rigid with the frame 28 and shaped as a grooved cam (FIG. 1). This causes the container tray 12 to rotate as the conveyor 13 advances (FIG. 5).

In this respect, in the first section A the pair of parallel conveyors 13, which are driven synchronously by a central drive, carries a series of transverse container trays 12 spaced apart by a distance equal to the maximum dimension of a container tray. When they have been rotated at the second section B they form a continuous succession of V-shaped seats extending in the illustrated non-limiting example through the length of three side-by-side controller trays. It is possible to carry eighteen cones 11 which are discharged onto the first collection means 15 for each of the two conveyors 13.

The pin 29, its wheel 30 and the grooved cam track 31 of the two side-by-side conveyors 13 are disposed specularly to each other so as to rotate the container trays 12 in opposite directions and thus orientate their contained cones 11 with their tails side by side and facing the centre of the second second B.

When at least three container trays 12, in the illustrated example, are positioned in succession one after the other with their contained cones 11 all parallel and perfectly aligned with the rack collection means 15, the conveyors 13 stop to allow the cones to be transferred.

The two transfer means 14 of the second section B are positioned on opposite sides to laterally face the outer sides of the conveyors 13 and are rigid with the frame 28. Each transfer means 14 consists of a pair of upper support uprights 32 on which endless chains 33 are mobile to move downwardly pointing arms 34 above the container trays 12. Each pair of arms 34 carries a thrust bar 35 which is at least as long as the total extension of the three container trays 12 which contain the cones 11. The thrust bar 35 is lowered so that it pushes the cones as it moves towards the center, and raises above the cones for its return outward movement.

Figure 4:
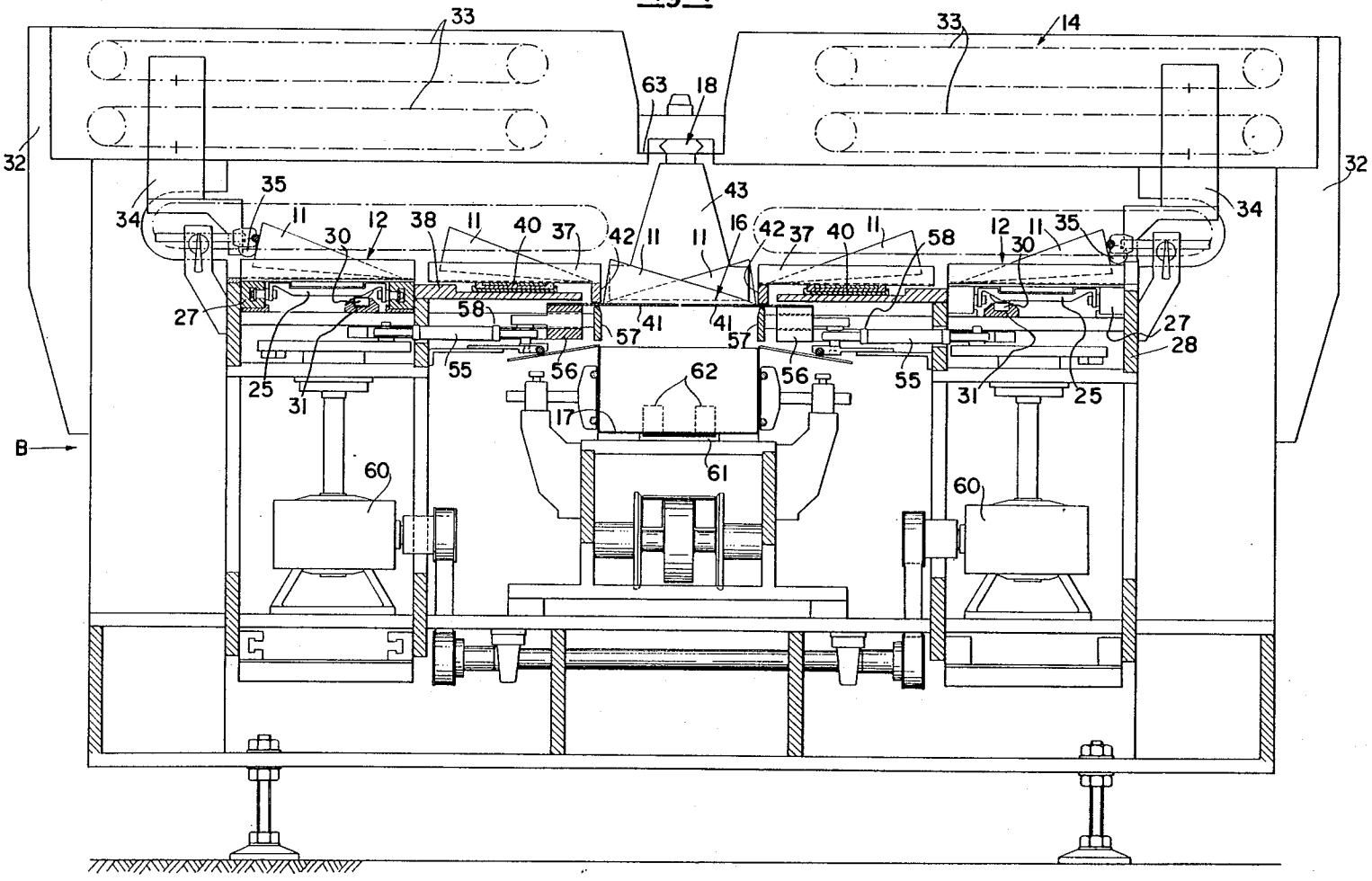
FIG. 4 is an enlarged cross-section on the line IV—IV of FIG. 1.

The pair of transfer means 14 is operated transversely to the second section B boxing plant to urge the two rows of cones 11 from opposite sides (FIG. 4) onto the two first rack-shaped collection means 15 which consist essentially of a longitudinal base plate 36 upperly carrying a series of U-shaped cavity seats 37 which form the rack and are identical to the seats 21 of the container trays 12. The base plates 36 are slidable on relative backing support plates 38 rigid with the frame 28 when operated by actuator cylinders 39 (FIG. 6) disposed at one end, with mutual slide members 40 interposed.

Figure 6:
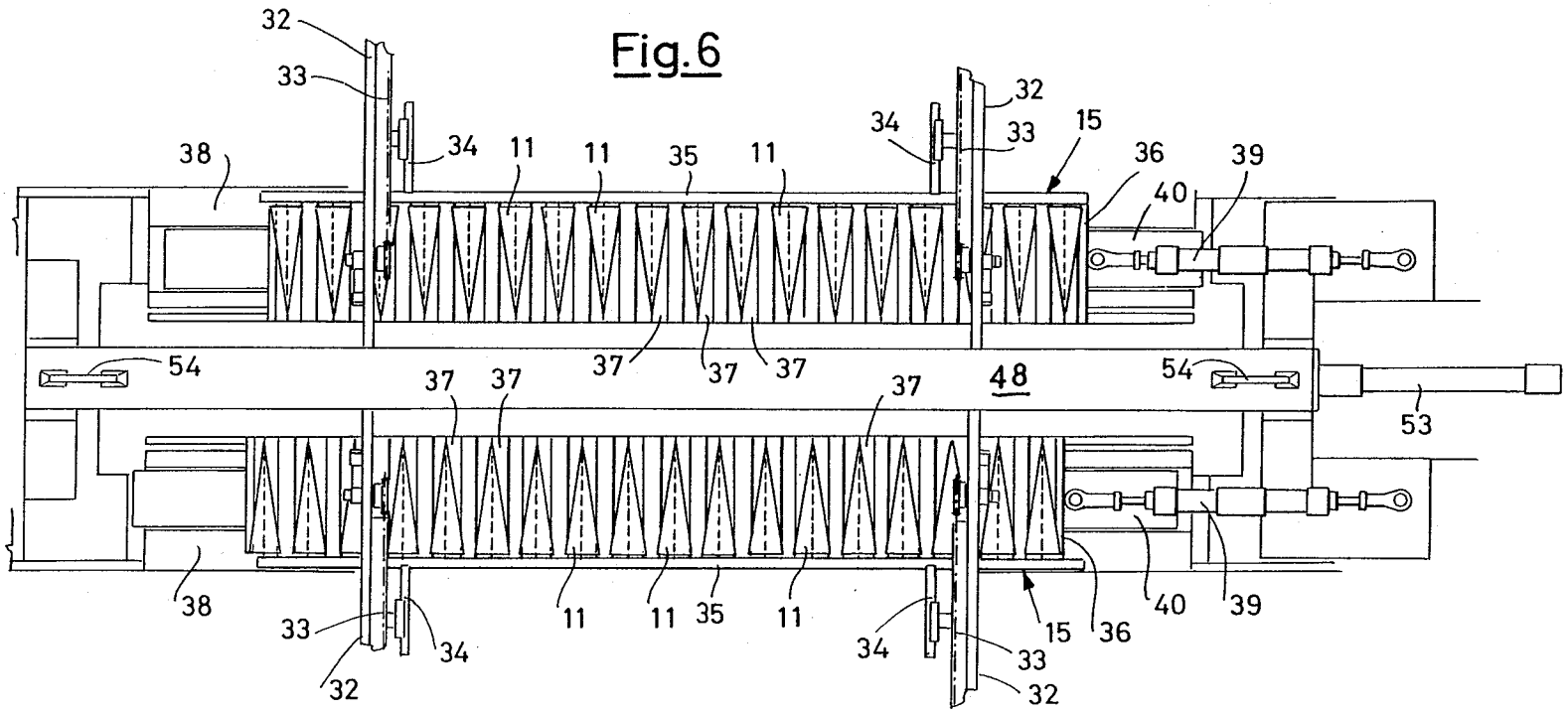
FIG. 6 is an enlarged plan view of a central portion of the second section of the apparatus.
Figure 8:
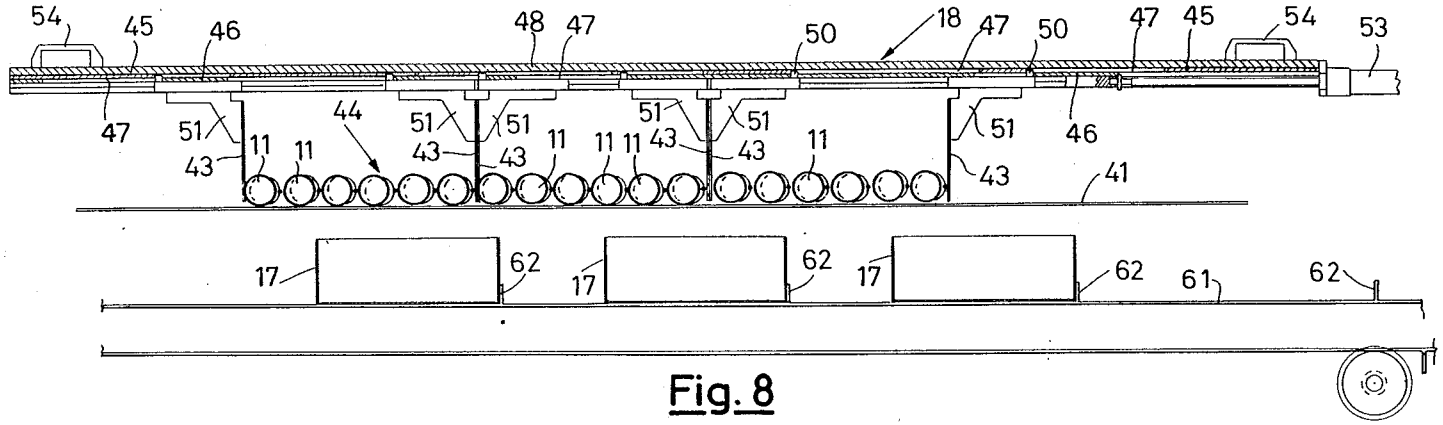
FIG. 8 is a diagrammatic elevation of the bladed compactors with underlying boxes in the position corresponding to FIG. 7.
Figure 7:
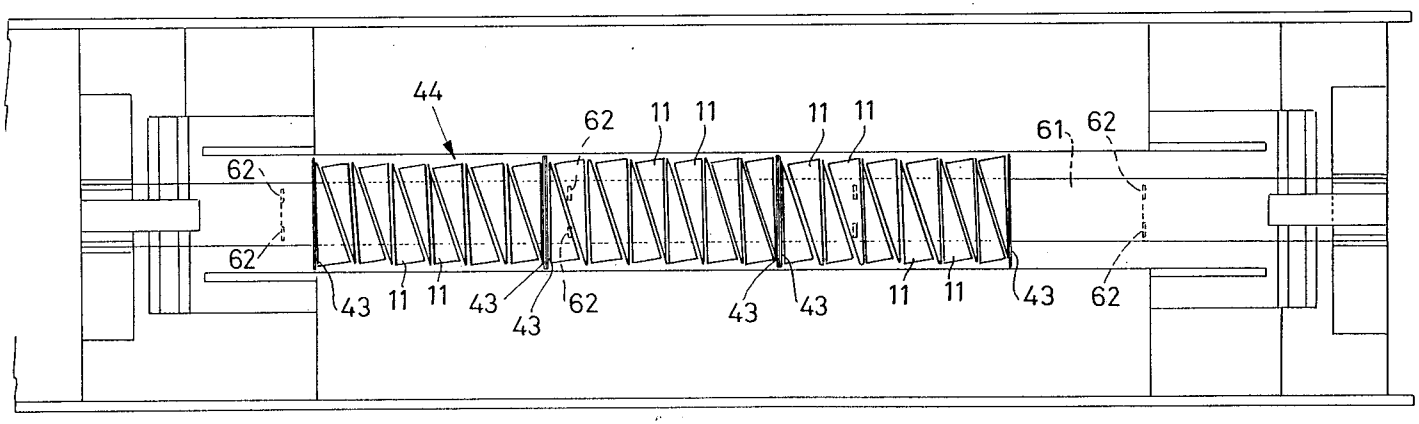
FIG. 7 is a diagrammatic enlarged plan view of a further position in the central portion of the apparatus.

The longitudinal movement of the first rack-shaped collection means 15 commences when the transfer means 14 begins to push the cones 11. As can be seen in FIG. 6 the two racks move in opposite directions each through ¼ of the width of two seats 37 so that the tails of opposing cones are offset by ½ of a width. Further advancement of the thrust bars 35 of the transfer means 14 urges the cones 11 discharged from the container trays 12 onto the second central collection means 16 above the open boxes 17 (FIGS. 7 and 8).

The second collection means 16 consist essentially of two identical flat blade elements 41 disposed on opposite sides of, but at a lower level than the racks 15 between identical side walls 42 of the base plates 36 to define a sort of drawer with two openable halves which can move so that they disappear below the first collection means 15.

Figure 11:
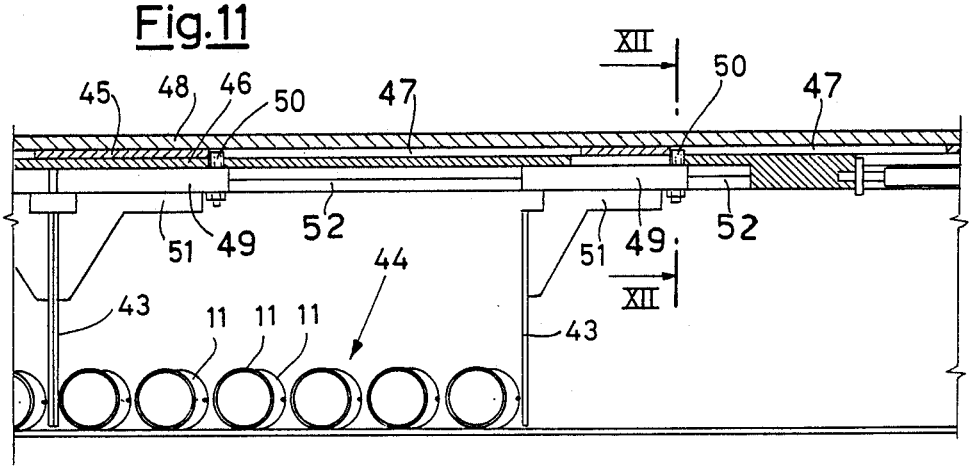
FIG. 11 is a sectional elevation of a detail of the compactor means.
Figure 12:
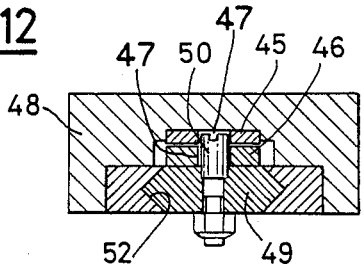
FIG. 12 is a cross-section through the upper part of the compactor means on the line XII—XII of FIG. 11.

Above the second collection means 16 there is positioned the compactor means 18 which with its series of mobile vertical blade-type walls 43 (FIGS. 8 and 10) disposed transversely to the second section B and the side walls 42 forms a series of false boxes for forming matrices 44 by eliminating the clearance between one cone and the next in the head-tail arrangement. The compactor means 18 is formed upperly (FIGS. 11 and 12) from a pair of flat bore 45, 46 provided with mutually offset grooves 47 of different lengths positioned horizontally one above the other within a support member 48. The first bar 45 is fixed and the second bar 46 is mobile together with a third lower profiled bar portion 49 which is slidable within a complementary seat 52 provided in the bottom of the member 48. The third bar portion 49 also carries a fixed pin 50 which slidably engages in the grooves 47 of the two bars 45 and 46.

Figure 10:
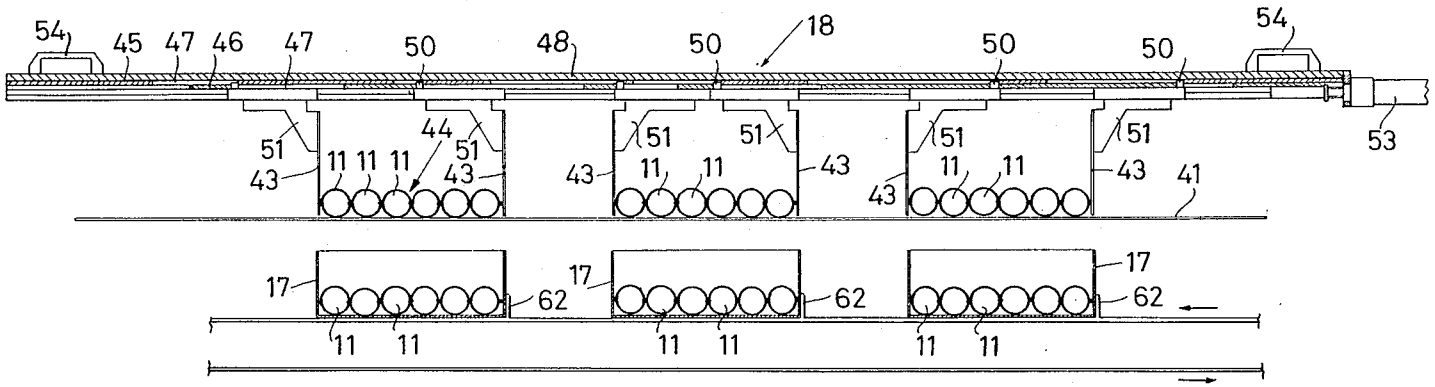
FIG. 10 is a diagrammatic elevation corresponding to the position of FIG. 9.
Figure 9:
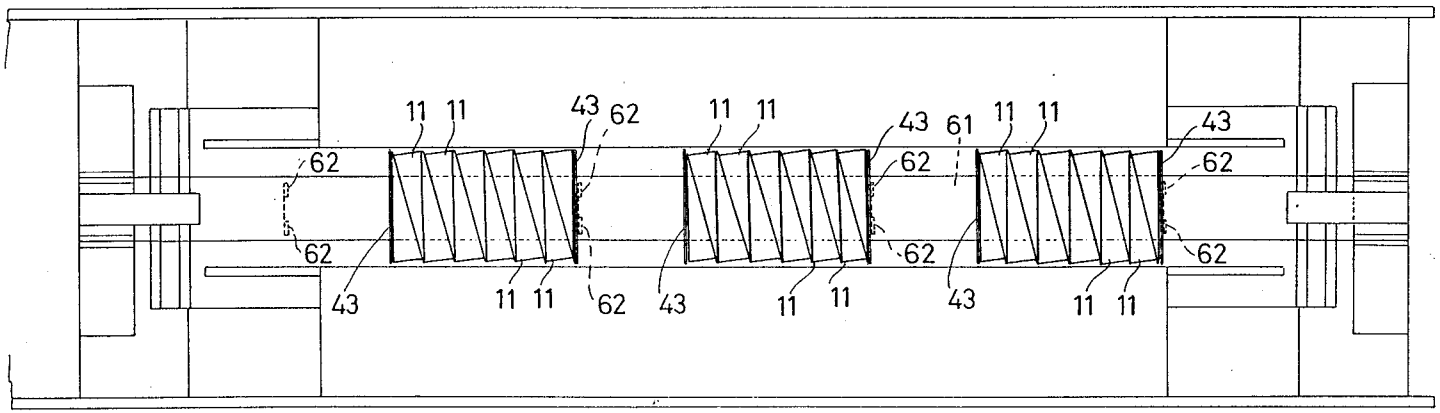
FIG. 9 is a plan view equivalent to FIG. 7 in a subsequent operating position.

Further pins 50 are rigid with carriage elements 51 of the same shape as the third bar portion 49 and carry the vertical blade-type walls 43, which extend downwards in a facing and/or opposing manner to form transverse walls of the matrices 44. An actuator cylinder 53 positioned at one end of the compactor means 18 moves the second bar 46 and the third bar portion 49 which by the interaction of the pins 50 of the carriage elements 51 and the grooves 47 of the second bar 46 and first fixed bar 45 cause the blade-type walls 43 to move correlatedly or in sequence. From a completely open position corresponding to that when occupied by the cones discharged from the first collection means 15 (FIGS. 7 and 8). The blade-type walls 43 are moved into the boxing position with the cones compacted in a head-tail arrangement (FIGS. 9 and 10).

The compactor means 18 is extractable and is mounted with individual stroke-of-travel and groove dimensions which differ according to the maximum diameter of the cones 11 and the number of cones making up the matrix to be formed. It can be replaced by one to meet the particular requirement by simply extracting it from above using a pair of handles 54, as it rests on appropriately shaped support seats 63 provided at the inner end of the uprights 32.

When the cone matrices 44 have been completed, two synchronised geared motor units 60 are operated to drive a pair of connecting rod-crank actuator mechanisms 55 which results in the movement of a sliding tube 56 carrying a relative flat blade element 41 towards each of the two sides so that the elements 41 are withdrawn under the first collection means 15. In this manner, the matrices 44 of cones 11 fall and are inserted into the underlying boxes 17. The fall is guided laterally by further longitudinal walls 57 rigid with support and slide shafts 58 for the slidable tubes 56.

During the operation the two transfer means 14 by virtue of their return movement have returned the pusher bars 35 into their initial position. The first rack-shaped collection means 15 have become realigned facing each other and the conveyors 13, again moving, have fed and positioned new container trays 12 filled with relative cones 11.

If the box compartment of the collection means 16 is to be filled with more than one layer of cones 11, in addition to providing a multiple feed of cones by successive operation of the transfer means 14, the first rack-shaped collection means 15 must be moved alternately once to one side and once to the other side of their initial facing position in order to form the individual layers. In this respect, when a first layer has been formed in the previously described manner, in order to form a second layer after the conveyors 13 with their container trays 12 full of cones 11 have stopped the first rack-shaped collection means 15 are moved by the actuator cylinders 39 in the opposite direction to that used for positioning the first layer. In this manner, the cones of the second layer become offset in accordance with a head-tail arrangement which is exactly the opposite of that of the underlying layer, so determining optimum filling of the box compartment 16.

As can be seen from FIGS. 1 and 2, when the container trays 12 have been emptied they move along an endless path back into their initial position. Along this path, in a region below the grooved tracks 31 (FIG. 5), further grooved tracks 31 rearrange the container trays 12 in a position transverse to the conveyors 13 ready to receive new groups of cones 11 from the chutes 19. The chains 26 of the conveyors 13 are driven along their endless path by a central geared motor unit coupled to an intermittent motion device 59 which causes the conveyors 13 carrying the container trays 12 to undergo intermittent movement even though the electric motor is always rotating. This enables the cones to be transferred into the second section B. A gearbox 65 is interposed between the geared motor-intermittent motion unit 59 and the drive sprockets 64 which drive the chains 26 so that by shifting gear in the gearbox the number of revolutions made by the drive sprockets 64 for the chains 26 can be changed for equal numbers of revolutions undergone by the geared motor-intermittent motion unit 59. This means that the apparatus is able to have different numbers of cones under load in the transfer region 15 and thus be able to form rows with different whole sub-multiples, making it possible to form different matrices.

Preferably in the central region the second section B there is longitudinally disposed a box conveyor means 61 which by pushers 62 spaced apart at constant pitch are able to feed open empty boxes 17 in succession and to remove them once filled with cones, for example for feeding them to a closing machine (not shown).

The apparatus according to the invention as heretofore defined is provided with suitable auxiliary control and synchronised operating means for the motors, geared motor units and actuators to provide automatic operation.

As an alternative, a single conveyor 13 can be used with consequent use of only one side of the apparatus if boxes are to be filled with only one layer of cones not in head-tail arrangement.

Advantageously, the container trays 12 can have any number of equidistant seats 21 of predetermined length and of a shape suitable for the particular product to be boxed.

I claim:

1. An apparatus for feeding groups of cones in an ordered and orientated arrangement to container boxes in a boxing plant to which at least two groups of cones of predetermined number are fed, characterised by comprising:

(a) a first section (A) comprising a pair of parallel conveyors (13, 25, 26), said pair of conveyors driven by an intermittently operated geared motor-intermittent motion unit (59,) for moving container trays (12) carrying in cavity seats (21) groups of cones (11) of predetermined number, said container trays (12) being disposed transversely to the movement of said pair of conveyors (13) to lay side-by-side during their translational motion, and being rotatable (23, 24) cam means for causing each of said container trays to rotate to (29, 30, 31) an essentially horizontal plane parallel to that in which the groups of cones (11) are disposed;

(b) a second section (b) in which said container trays (12) of one conveyor (13) of said pair of conveyors are arranged side by side and face respective container trays (12) of the other parallel conveyor (13) of said pair of conveyors so that the groups of cones of the one conveyor are in parallel alignment with and facing the groups of cones of the other conveyor, with tails of the cones pointing towards the center of said apparatus, each side of said second section (B) having transferring means (14, 33, 35) movable transversely to said conveyors (13) for transferring the groups of cones from said container trays (12) to a position above centrally positioned container boxes (17);

(c) first collection means (15) for the groups of cones (11) transferred from said container trays (12), said first collection means (15) being essentially of the rack type (36, 37) and each is positioned to the side of said conveyors (13) towards the center of said second section (B), both of said first collection means being provided with actuators (39) which move said first collection means horizontally in opposite directions parallel to the movement of said conveyors so as to offset the cones present on one of said first collection means with respect to the cones present on the other of said first collection means;

(d) second collection means (16) for receiving the groups of cones (11) transferred from said first collection means (15), said second collection means (16) being disposed centrally to said second section and consisting of flat blade elements (41), said flat blade elements of said second collection means can be opened out above the container boxes (17) after receiving the cones fed by said transfer means (14) from both sides upon both of said first collection means, and after the cones have been intercalated in a head-tail arrangement and have been divided and compacted into a number of identical matrices (44) of same dimensions as the underlying boxes (17) by an associated compactor means (18) with blades (43) which are transverse to said second section (B), said blades (43) of said compactor means being moved parallel to movement of said conveyors by at least one actuator (53).

2. An apparatus as claimed in claim 1, wherein below and in correspondence with said second collection means (16) of said second section (B) there is provided a conveyor means (61) comprising pushers (62) spaced apart at a constant pitch for feeding the boxes (17).

3. An apparatus as claimed in claim 1, wherein said pair of conveyors (13) is each composed of pairs of endless chains (26) which traverse both said first section (A) and said second section (B), said chains (26) being slidably supported on slide guides (27) rigid with a frame (28) of said apparatus.

4. An apparatus as claimed in claim 3, wherein said geared motor-intermittent motion unit (59) is associated with a gearbox (65) for controlling drive sprocket wheels (64) causing movement of said chains (26), gear ratios of said gearbox (65) being variable so as to vary the number of revolutions made for each revolutions of said geared motor-intermittent motion unit (59).

5. An apparatus as claimed in claim 3, wherein each pair of chains (26) comprises a series of transverse supports (25) rotatably carrying out of said container trays (12) in a centrally pivoted manner (23, 24).

6. An apparatus as claimed in claim 1, wherein said container trays (12) comprise a base plate (22) on the upper side of which there is fixed a plate (20) shaped to define a series of said cavity seats (21) which are V-shaped.

7. An apparatus as claimed in claim 6, wherein said cam means consist respectively of a continuous track (31) rigid with said apparatus frame (28) and a wheel (30) which extends below a base plate (22) in a position eccentric to a central pivot (24) of said container tray (12).

8. An apparatus as claimed in claim 1, wherein said transfer means (14) consist of arms (34) carrying a pusher bar (35) and positioned on endless chains (33) movable on pairs of uprights (32) rigid with said apparatus frame (28) in a direction transverse to said conveyors (13).

9. An apparatus as claimed in claim 1, wherein said first collection means (15) each comprise a longitudinal base plate (36) upperly carrying a series of V-shaped cavity seats (37).

10. An apparatus as claimed in claim 9, wherein said longitudinal base plate (36) is slidable on a backing plate (38) by way of interposed mutual slide members (40).

11. An apparatus as claimed in claim 9, wherein said longitudinal base plates (36) disposed on opposite sides each move longitudinally in opposite directions through $\frac{1}{4}$ of a said cavity seat (37) so as to offset the tails of opposing cones (11) by $\frac{1}{2}$ of one pitch.

12. An apparatus as claimed in claim 1, wherein said flat blade elements (41) of said second collection means comprise two halves which can be moved to totally withdraw below said first collection means (15).

13. An apparatus as claimed in claim 1, wherein said second collection means (16, 41) are disposed at a lower level than said first collection means (15, 37).

14. An apparatus as claimed in claim 1, wherein said compactor means (18) with blades (43) transverse to said second section (B) comprises a pair of flat bars (45, 46) possessing mutually offset grooves (47) of different lengths into which pins (50) rigid with said blades (43) of said compactor means are inserted, one (45) of said bars being fixed relative to a containing member (48) and the other (46) being movable by said at least one actuator (53) to cause said blades 43 of said compactor means to move.

15. An apparatus as claimed in claim 1, wherein said compactor means (18) is extractable from seats (63) provided at the inner ends of uprights (32) which are transverse to said second section (B) and carry said transfer means (14, 33, 35).

16. An apparatus as claimed in claim 14, wherein said blades (43) of said compactor means are rigid with carrage elements (51) slidable in a complementary seat (52) provided longitudinally in the lower part of the containing member (48) below said two flat bars (45, 46), each of said carriage elements (51) ridigly comprising one of said pins (50).

* * * * *